United States Patent [19]

Cordier et al.

[11] Patent Number: 4,852,995

[45] Date of Patent: Aug. 1, 1989

[54] PROCESS FOR DESULFURIZING FUEL GAS CONTAINING SULFUR

[75] Inventors: Jean Cordier, Saint Saulve; André Rist, Gif-sur-Yvette, both of France

[73] Assignee: Union Siderurgique du Nord et de L'Est de La France, Puteaux, France

[21] Appl. No.: 51,152

[22] Filed: May 15, 1987

Related U.S. Application Data

[63] Continuation of Ser. No. 703,659, Feb. 21, 1985, abandoned.

[30] Foreign Application Priority Data

Feb. 23, 1984 [FR] France ..... 84 02769

[51] Int. Cl.[4] ..... C10J 3/46; C10K 3/00

[52] U.S. Cl. ..... 48/197 R; 48/210; 423/220; 423/230

[58] Field of Search ..... 48/92, 197 R, 210; 423/220, 230, 210.5

[56] References Cited

U.S. PATENT DOCUMENTS

| | | | |
|---|---|---|---|
| 2,612,444 | 9/1952 | Rummel | 48/92 |
| 2,858,255 | 10/1958 | Segui et al. | 48/92 |
| 3,983,218 | 9/1976 | Heins | 423/244 |
| 4,141,694 | 2/1979 | Camacho | 48/92 |
| 4,180,549 | 12/1979 | Olsson et al. | 423/230 |
| 4,388,084 | 6/1983 | Okane et al. | 48/210 |
| 4,436,529 | 3/1987 | Fahlstrom et al. | 48/92 |

FOREIGN PATENT DOCUMENTS

| | | |
|---|---|---|
| 2620954 | 11/1977 | Fed. Rep. of Germany . |
| 2843997 | 4/1980 | Fed. Rep. of Germany . |

*Primary Examiner*—Peter Kratz

*Attorney, Agent, or Firm*—Cushman, Darby & Cushman

[57] ABSTRACT

The invention relates to a process for effecting a high desulphuration of a fuel gas containing sulphur issuing from the gasification of sulphurous fuels, wherein the gas is subjected to the action of vapors of manganese and/or zinc and/or oxides thereof (in the form of aerosols) while it is at a temperature ranging from 1 600° C. to 350° C.

13 Claims, 2 Drawing Sheets

Desulphuration with separate metallic vapours

Desulphuration with separate metallic vapours

PROCESS FOR DESULFURIZING FUEL GAS CONTAINING SULFUR

Figure 1:
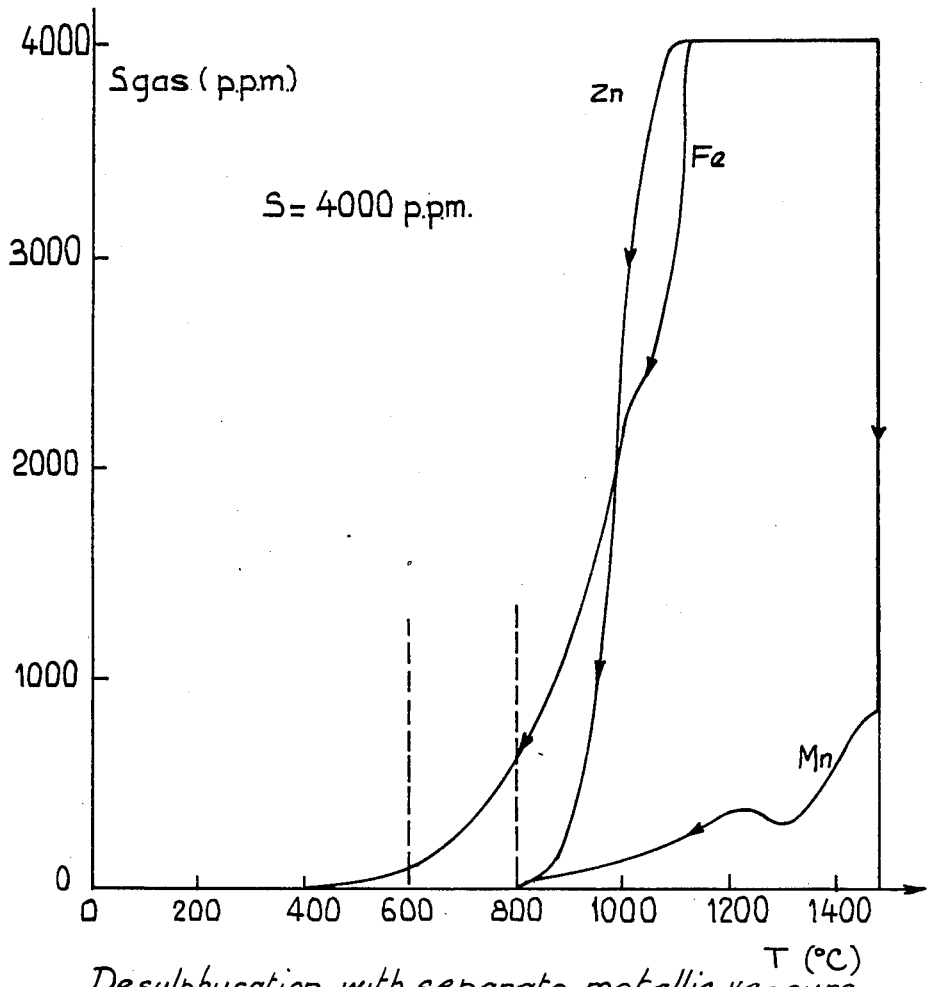

This is a continuation of application Ser. No. 703,659, filed Feb. 21, 1985 which was abandoned upon the filing hereof.

The present invention relates to a process for a desulphuration of a fuel gas of synthesis containing sulphur, such as in particular a fuel gas obtained by the gasification of coals or petroleum residues.

The invention concerns in particular a fuel gas obtained by gasification of coal by means a bath of ferrous metal maintained in the liquid state, the coal being injected in the powdered form into the bath of metal by an injecting nozzle simultaneously with gaseous oxygen and vapour.

The gas produced in this way contains a residual content of sulfur compounds, in particular in the form of $H_2S$ and COS which is of the order of 100 to 600 p.p.m.v. of $H_2S+COS$. It may be noted that relative to the sulfur contents of the gas initially produced, a first considerable desulfurization by the iron has already occurred so as to convert the sulfur compounds into iron sulfide, but this desulfurization is insufficient for certain uses of the gas.

An object of the present invention is to solve this problem of highly desulfurizing of a fuel gas issuing from the gasification of sulfurous fuels.

The invention thus provides a process for desulfurizing a fuel gas containing sulfur issuing from the gasification of sulfurous fuels, comprising subjecting it to the action of vapours of manganese and/or zinc and/or oxides thereof in the form of aerosols while it is at a temperature ranging from 1600° to 350° C.

The desulfurization by the manganese is preferably carried out by putting the fuel gas in contact with the vapours of Mn and/or of its oxides in the form of aerosols when it is at a temperature ranging from 1 600° C. to 600° C.

The desulfurization with the zinc is on the other hand preferably effected by putting the fuel gas in contact with vapours of zinc and/or the oxides thereof in the form of aerosols while it is at a temperature ranging from 1 000° C. to 350° C.

In the gasification in iron metallurgy by means of a bath of pure cast iron (non alloyed), the vaporization of the iron and the amount of vaporized iron condensing in the form of aerosols of particles of metallic iron and iron oxides is very considerable. The considerable specific surface area of the iron and iron oxide causes the desulfurization of the gas, provided the latter is sufficiently reducing (low content of $CO_2$ and $H_2O$). The desulfurization reaction occurs beyond 1 100° C. and can continue to about 400° C. inasmuch as the collecting installations are suitably designed to allow the gas a sufficiently long period of stay, in particular within the range of temperatures of 600° to 800° C. Under these conditions, irrespective of the initial sulfur content of the gas, (in the form of mainly $H_2S$ and COS, $S_2$, etc . . . ), the sulfur content of the gas cooled in the presence of iron and iron oxide aerosols is reduced to values between 100 and 600 p.p.m.v. of sulfur, in the form of $H_2S$, COS, etc . . . The sulfur is eliminated by a purification and a high dedusting of the gas, in the form of sulfides and iron oxysulfides.

This desulfurization with iron, which is inherent in the very process of gasification of coal by means of a bath of iron maintained at a temperature higher than 1 300° C., is however insufficient for certain applications, owing to the residual sulfur content.

According to the invention, in order to achieve a more rapid and a higher desulfurization, there is introduced in the gas produced by gasification, vapours of manganese and/or zinc, and/or oxides thereof.

The manganese is very volatile. Its vapours react at high temperature, immediately, with the sulfurous compounds contained in the gas, if the latter is sufficiently reducing ($CO_2$ content<5%). At 1 500° C., the sulfur content of the gases is already reduced to 900 p.p.m.v. In the course of the cooling of the gas in the presence of vapours (in the form of aerosols) of manganese and manganese oxides, the desulfurization continues and, at 800° C., there remains only 50 p.p.m.v. of sulphur in the gas. In a suitably designed installation (sufficient volume and period of stay), the reaction can continue at lower temperatures, owing to the large specific surface area of the aerosol produced.

If the reaction can continue to 600° C. and even 400° C., the residual sulfur content is extremely low: on the order of a few p.p.m.v.

Zinc is a desulfurizing agent which is still more effective than the manganese at lower than 950° C. It completes the action of the vapours of manganese introduced in the gas. Beyond 850° C., the zinc sulfide is more stable than the manganese sulfide, and the vapours of zinc in the aerosols rapidly fix the sulfur of the gas in the form of zinc sulfides and zinc oxysulfides, so that at 800° C., the gas contains less than 10 p.p.m.v. of sulfur. At 600° C., the residual sulfur content in the gas is less than a few p.p.m.v.

The sulfur is eliminated from the gas, purified and dedusted, in the form of fine dusts of zinc sulfides and zinc oxysulfides, manganese and iron.

FIG. 1 is a graph illustrating the separate action of the vapours of Fe, Mn and Zn on the desulfurization of a gas issuing from the iron metallurgical gasification of coal in which the initial sulfur content is 4 000 p.p.m.v. and the initial content of each of the metals (M) is 0.5 to 1 g/N $m^3$.

To obtain a moderate desulfurization (industrial gas whose sulfur content must be lowered to below 1 000 p.p.m.v.), it is found upon examination of the graph shown in FIG. 1 that a desulfurization with vapours of iron is sufficient inasmuch as an appropriate vaporization of iron vapours occurs from the bath maintained at a temperature ranging from 1 300° C. to 1 600° C.

In respect of fuels, and in particular coals having a normal sulfur content, one may proceed by maintaining the bath of iron at temperatures preferably between 1 450° C. and 1 550° C.

In respect of fuels having a very high sulfur content, it is preferred that the bath of iron be maintained at a temperature between 1 500° C. and 1 550° C.

However, in order to obtain a high desulfurization which is the object of the invention, according to a first manner of carrying out the invention, manganese is added in the gasification zone while the gas is maintained at a temperature ranging from 1 600° C. to 600° C.

The Mn may be added in the form of oxide such as,for example, a manganese concentrate or ore, directly mixed with the powdered coal injected by the nozzle.

The Mn may also be added to the bath in the form of ferro-manganese or spiegel or any other alloy containing Mn.

The Mn content of the bath is maintained preferably between 0.5 and 1.5% and for example about 0.8%.

The introduction of manganese, in order to ensure the desulfurization, is particularly recommended in the case of the gasification of fuels having a high sulfur content, such as sulfurous coals, asphalts, petroleum coke. The latter could be hindered by an excessive content of sulfur of the bath of liquid metal. Indeed, it is necessary to maintain if possible the sulfur content of the bath at less than 2% so as to obtain a complete and effective gasification of the injected coal, without excess of vapour and oxygen, so as to obtain a gas of good quality whose $CO_2$ content remains lower than 5%.

It is indeed under these conditions that an effective desulfurization is also obtained with the manganese aerosol, As explained before, under these conditions of injection, the manganese introduced is rapidly vaporized and ensures a desulfurization of the bath at the same time as a desulfurization of the gas (which cannot be ensured solely by desulfurization with iron vapours which intervene only at a lower temperature, as mentioned before).

According to an additional manner of carrying out the invention, in order to obtain a gas having a very low sulfur content (<10 ppm), the desulfurizing action of the manganese is completed by the addition of vapours of Zn which react when the gas is at a temperature lower than 1 000° C. and ranging down to 350° C.

This putting of the gas in contact with the vapours of Zn may be achieved according to two modifications of the invention.

According to a first modification, the vapors of Zn are created:

either by introducing metallic waste containing zinc in the bath of metal; these wastes may come from the recovery of the breaking up of automobiles, for example (Zn-A1-Mg alloys and Zn-Cu alloys having a low melting point, etc . . . );

or in the form of dusts containing zinc, which will be added to the powdered coal, typically concentrates of zinc oxides in various forms; there may be employed to advantage dusts of electric furnaces which constitute industrial residues whose zinc content may reach 18 to 25%.

The zinc, introduced in a high temperature zone, is entirely volatilized. However, its consumption is negligible, since it intervenes, as explained before, at a temperature lower than about 950° C., jointly with the manganese aerosols,while the sulfur content of the gas is still on the order of 20 to 40 p.p.m.v. of sulfurous compounds.

According to a second manner of carrying out the invention for reducing the consumption of Zn, it is vaporized in a plasma torch which injects the Zn vapour into the gas while it is at a temperature lower than 600° C., when the manganese has already reduced the sulfur content of the gas to less than 10 p.p.m.v.

Figure 2:
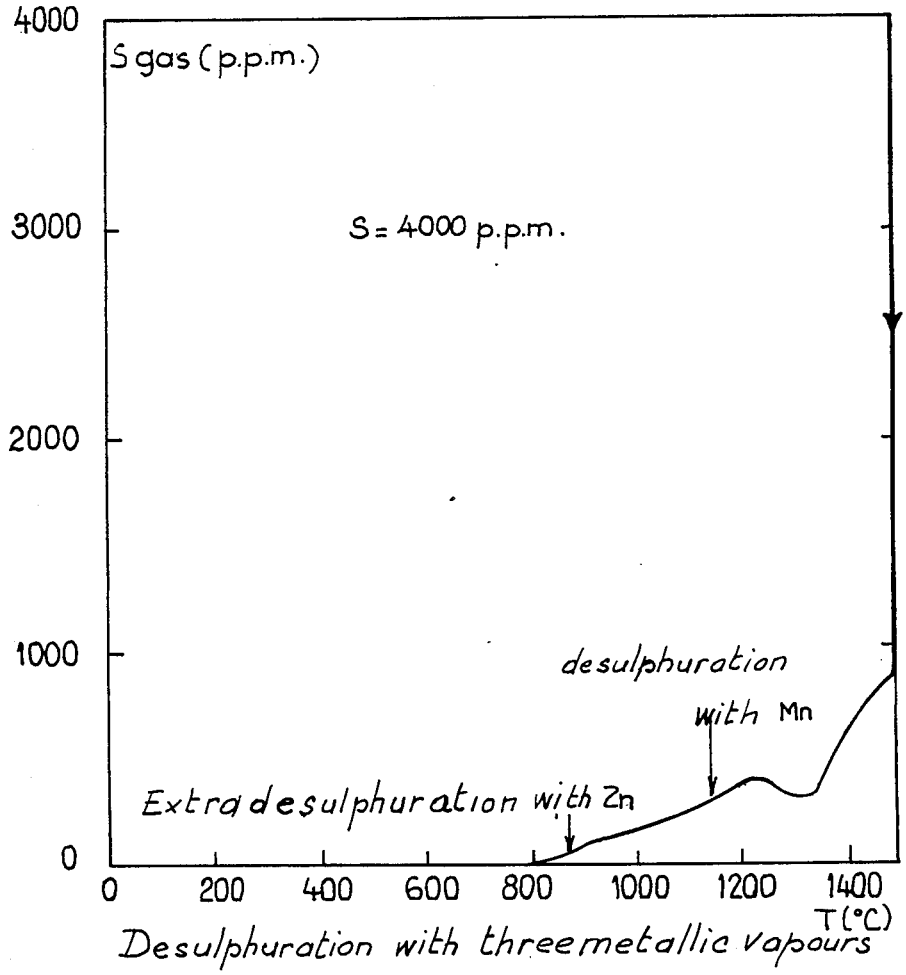

FIG. 2 is a graph illustrating the simultaneous action of the vapours of Mn and Zn on the desulfurization of a gas issuing from the iron metallurgical gasification of coal in which the initial sulfur content is 4 000 p.p.m.v. ($COS+H_2S$, + . . . ), the Mn content being higher than 0.3 g/m$^3$ N, and in particular from 0.5 to 1 g/m$^3$ N, the Zn content being higher than 0.01 g/m$^3$ N, and in particular from 0.05 to 0.1 g/m$^3$ N.

The products of the desulfurization of the gas which are in the form of fine dusts of sulfides and oxysulfides of iron, Mn and Zn, are eliminated by a high purification by means of an electrostatic filter after the gas has been put into condition.

What is claimed is:

1. A process for desulfurizing in a fuel gas desulfurizing plant a fuel gas containing sulfur resulting from a gasification of a sulfur-containing fuel by means of a bath of liquid iron in said plant, comprising:

allowing the gas resulting from said gasification of said sulfur-containing fuel by means of said bath of liquid iron to cool during a sufficient stay in a sufficient volume within said plant down to the following recited temperatures so as to treat the gas first by the action of vapours of a first substance selected from at least one of the group consisting of manganese and manganese oxides, in the form of aerosols, which action occurs while the gas is at a temperature ranging from 1600° C. to 600° C., said vapours being produced by directing a jet of oxygen onto the bath of liquid iron which liquid iron is at a temperature of 1300° C. to 1600° C. so as to cause the volatilization of said substance by the encounter of the jet with the bath and a thorough vaporisation of said substance, and then treat the resulting gas by means of the action of vapours of a second substance selected from the group consisting of zinc and zinc oxides, which action of said vapours of said second substance occurs while the gas is at a temperature of between 1000° C. and 350° C.

2. A process according to claim 1, wherein said vapours of said second substance are in the form of aerosols.

3. A process according to claim 1, wherein the fuel gas is a gas resulting from the gasification of a fuel selected from at least one of the group consisting of coal and petroleum residues by means of a liquid bath of iron which is maintained at a temperature of 1300° C. to 1600° C., depending on the sulfur content of the gas.

4. A process according to claim 3, wherein said bath of liquid iron is maintained at a temperature of 1450° C. to 1550° C.

5. A process according to claim 1, wherein said first substance is added to the fuel to be gasified in the form of fine ores of Mn.

6. A process according to claim 1, wherein said first substance is added to the bath of iron in the form of ferro-manganese.

7. A process according to claim 1, wherein said first substance is added to the bath of iron in the form of an alloy of Mn.

8. A process according to claim 1, wherein said second substance is added to the bath of iron in the form of scrap containing zinc.

9. A process according to claim 1, wherein said second substance is added to the bath of iron in the form of residues containing zinc.

10. A process according to claim 1, wherein said second substance is added to the bath of iron in the form of dusts of electric furnaces containing zinc.

11. A process according to claim 1, wherein said second substance is added to the bath of iron in the form of scrap of zinc alloys containing zinc.

12. A process according to claim 1, wherein said second substance in the form of zinc is put in contact with the gas which has been previously desulfurized by vapours of the iron of the bath and manganese downstream of points of putting the gas in contact with the iron and said first substance, relative to the direction of travel of the gas through said plant, in the form of zinc vapours produced by a plasma torch, the gas being at that time at a temperature lower than 600° C.

13. A process for highly desulfurizing a fuel gas containing sulfur resulting from gasification of a sulfur-containing fuel by means of a bath of liquid iron, comprising first treating the gas by the action of vapours of a first substance selected from at least one of the group consisting of manganese and manganese oxides in the form of aerosols said action of said vapours of said first substance occurring while the gas is at a temperature ranging from 1600° C. to 600° C., then completing the desulfurization of the gas by putting the gas resulting from the preceding desulfurization in contact with vapours of a second substance selected from at least one of the group consisting of zinc and zinc oxides, in the form of aerosols, said vapours of said second substance exerting an action on said gas while the gas is at a temperature ranging from 1000° C. to 350° C., said vapours of said substances being produced by directing a jet of oxygen onto the bath of liquid iron so as to cause the volatilization of said substances by the encounter of the jet with the bath of liquid iron and substantially the complete vaporization of said substances, said bath of liquid iron being maintained at a temperature of 1300° C. to 1600° C., depending on the sulfur content of the gas.

* * * * *